United States Patent [19]

Chambers

[11] 4,007,915

[45] Feb. 15, 1977

[54] JACKING APPARATUS

[75] Inventor: Henry B. Chambers, Santa Inez, Calif.

[73] Assignee: Hydranautics, Goleta, Calif.

[22] Filed: Dec. 15, 1975

[21] Appl. No.: 640,952

[52] U.S. Cl. ..... 254/108; 104/147 R; 104/165

[51] Int. Cl.[2] ..... B66F 1/04

[58] Field of Search ..... 254/108, 109, 111, 105, 254/93 R, 106, 107; 29/244, 252; 104/7 R, 147 R, 154, 162, 165; 105/31, 161, 30, 32; 198/109, 110, 218, 221; 214/1 BB

[56] References Cited

UNITED STATES PATENTS

| | | | |
|---|---|---|---|
| 2,803,357 | 8/1957 | Ronfeldt | 254/106 |
| 3,373,971 | 3/1968 | Chambers et al. | 254/107 |
| 3,464,095 | 9/1969 | Chambers | 254/107 X |
| 3,527,442 | 9/1970 | Korkut | 254/106 |
| 3,559,954 | 2/1971 | Chambers et al. | 254/106 |
| 3,659,823 | 5/1972 | Griffin | 254/93 |
| 3,870,279 | 3/1975 | Century | 254/105 |

*Primary Examiner*—James R. Duzan
*Attorney, Agent, or Firm*—Clement H. Allen

[57] ABSTRACT

A jacking apparatus comprises a rail having a plurality of pairs of vertical slots longitudinally spaced apart. A sled slides along this rail and has cross members to which are pivotably attached ends of hydraulic cylinders, the other ends of the hydraulic cylinders being pivotably attached to cross heads which also slide along the rail. The cross heads have bevelled latches, slidable vertically, and longitudinally reversible for engagement with the slots in the rail; so that repetitive, reciprocal movement of the hydrauic cylinder pistons will cause successive, incremental movements of the sled and a load selectively pushed or pulled by the sled along the rail.

7 Claims, 6 Drawing Figures

JACKING APPARATUS

BACKGROUND OF THE INVENTION

1. The Field of the Invention

This invention relates to jacking apparatus for moving a load along a rail.

2. The Prior Art

Prior art jacking devices or apparatus for moving a heavy load along a rail have generally comprised cars or sleds with large hydraulic cylinders operatively connected to claws or dogs which successively engage holes or slots in a rail. The units have been strongly constructed but usually of massive, inflexible design, and with claws or dogs accurately placed to engage carefully machined and located rail holes or slots. Careful fabrication and placement of claws or dogs and holes or slots has been necessitated by the strong rigid, construction requiring accurate location of mating surfaces when these elements engage and disengage during repetitive, reciprocal movement of a hydraulic cylinder piston and resulting incremental movement imparted to the load. Large hydraulic cylinders and massive construction can provide adequate moving power, but lack flexibility for power distribution to a plurality of claws or dogs, if employed, for engagement with the rail holes or slots. Additionally, heavy and rigid mechanical connections between hydraulic cylinders and claws or dogs have resulted in less readily reversed mechanisms to provide movement of the load in the reverse direction, that is, for example, pulling instead of pushing.

SUMMARY OF THE INVENTION

Summarized briefly, this invention comprises jacking apparatus having a plurality of hydraulic cylinders arranged to move a load along a slotted rail. The rail slots are vertical and arranged in transversely aligned pairs uniformly spaced along the rail. A sled comprising a pair of side members pivotably connected to a plurality of cross members is slidably mounted on the rail. A plurality of cross heads are also slidably mounted on the rail each spaced from each of the sled cross members and having turned-under lower edges to capture the side edges of the rail. Hydraulic cylinders are pivotably attached between the outer ends of each of the cross heads and the adjacent sled cross member. A pair of transversely aligned latches having longitudinally bevelled bottom surfaces is mounted in each of said cross heads so as to be vertically slidable and engageable with the pairs of transversely aligned slots in the rail. The pairs of latches in the cross heads are maintained in transverse alignment with the pairs of sots in the rail. The hydraulic cylinders are connected to a source of fluid under pressure applied alternately to each side of their pistons to cause alternate retraction and extension of the piston rods and corresponding reciprocal movement of the cross heads with respect to the sled. This causes repetitive, incremental movement of the sled along the rail, the cross head latches holding in the rail slots when the cross heads are moved with respect to the sled in one direction, and sliding over the slot edges when the cross heads are moved in the other direction. The load to be moved may be engaged by a push bar on an end of the sled. The slots in the rail are preferably flame cut.

DESCRIPTION OF A PREFERRED EMBODIMENT

Figure 1:
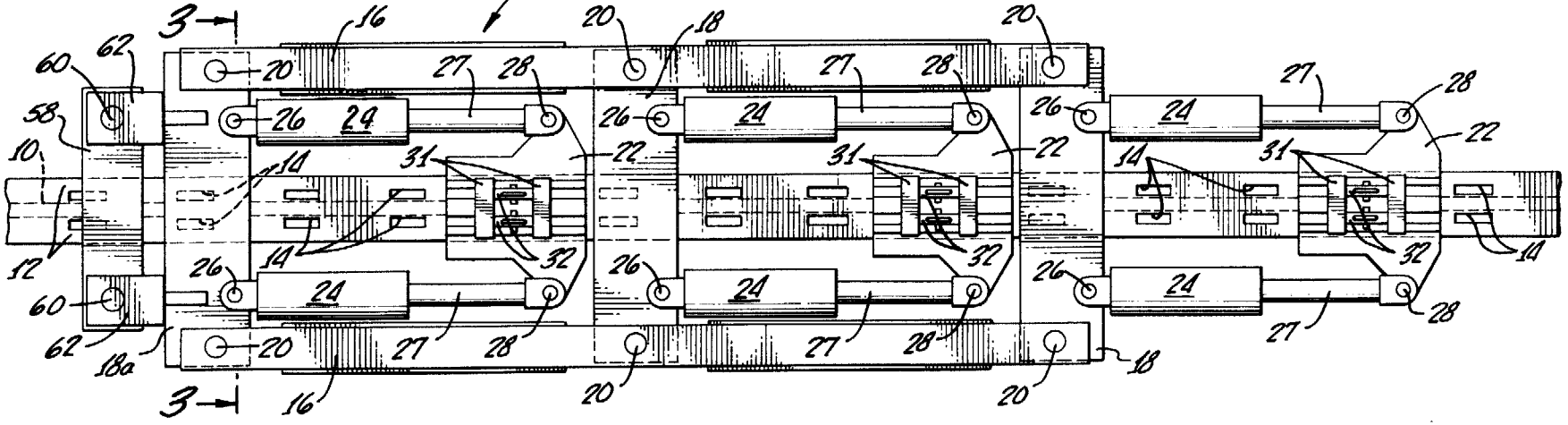
FIG. 1 shows a top view of jacking apparatus embodying features of this invention.
Figure 2:
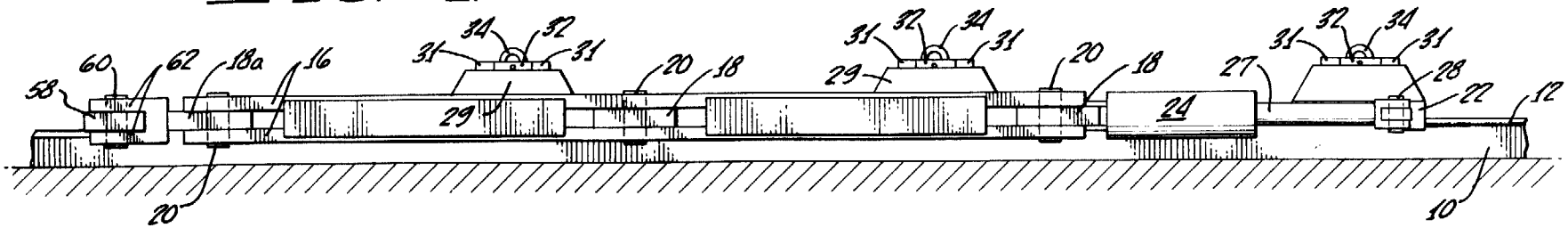
FIG. 2 shows a side view of the jacking apparatus of FIG. 1.
Figure 3:
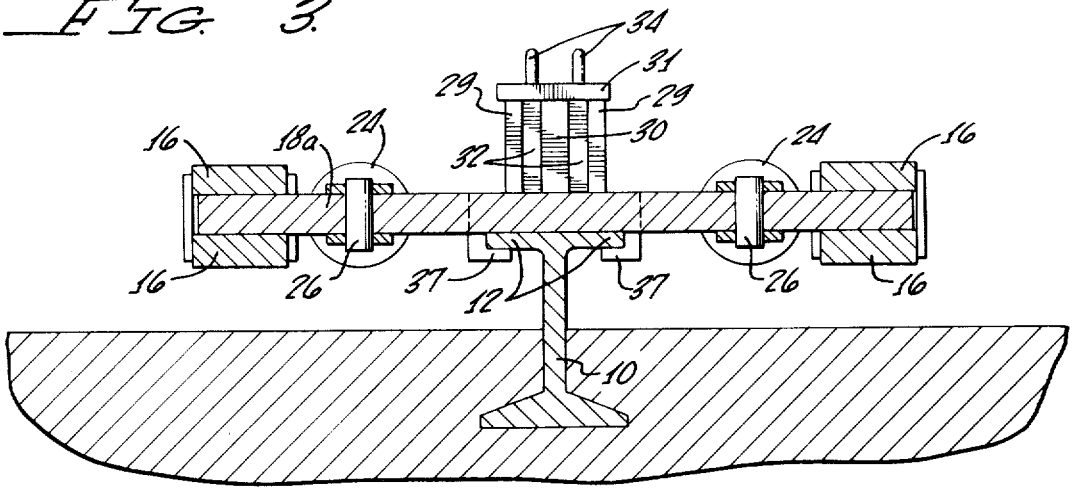
FIG. 3 shows a vertical section of the jacking apparatus of FIG. 1 taken along the line 3 — 3.

Referring now particularly to FIGS. 1 to 3, the jacking apparatus comprises a rail 10 which is of suitable length and may be mounted by setting on or in a supporting medium which may be a ground, or dockyard surface, or a barge deck, for example. Rail 10 has a top flange 12 in or through which are preferably flame cut a plurality of pairs of vertical slots 14, the slots 14 in each pair being transversely aligned and the pairs of slots 14 spaced apart uniformly along rail 10. A sled 15 comprises a double pair of spaced apart side members 16 spanned by a plurality of cross members 18 which are pivotably attached at their ends to side members 16 as by bolts or pins 20. Cross members 18 are slidably mounted on rail 10, more specifically as shown, on flange 12 of rail 10. Also slidably mounted on flange 12 of rail 10 are cross heads 22 which are each individually spaced from an adjacent sled cross member 18 by double acting hydraulic cylinders 24, each of whose one end, for example the cylinder end as shown, is pivotably attached to a sled cross member 18 as by a bolt or pin 26, and whose other end, that is the end of piston rod 27 as shown, is pivotably attached to an outer end of a cross head 22 as by a bolt or pin 28.

Figure 4:
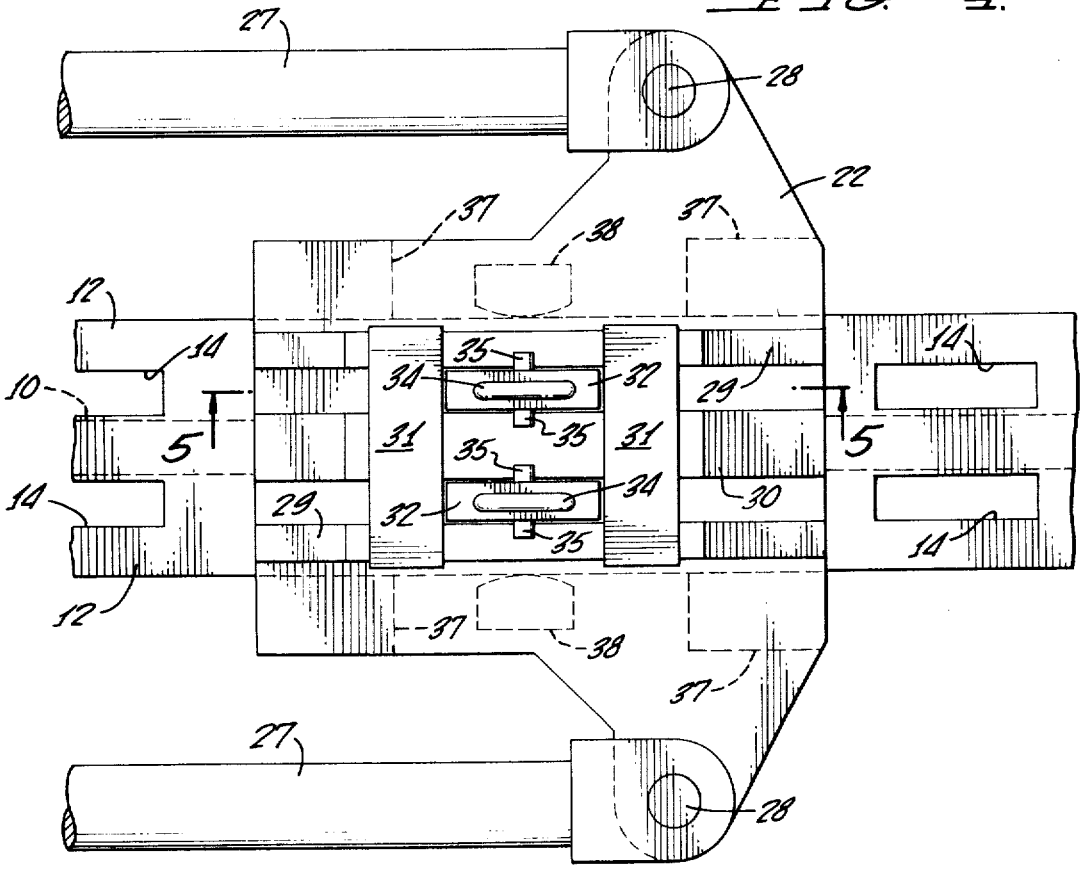
FIG. 4 shows an enlarged top view of one of the cross heads of the jacking apparatus of FIG. 1.
Figure 5:
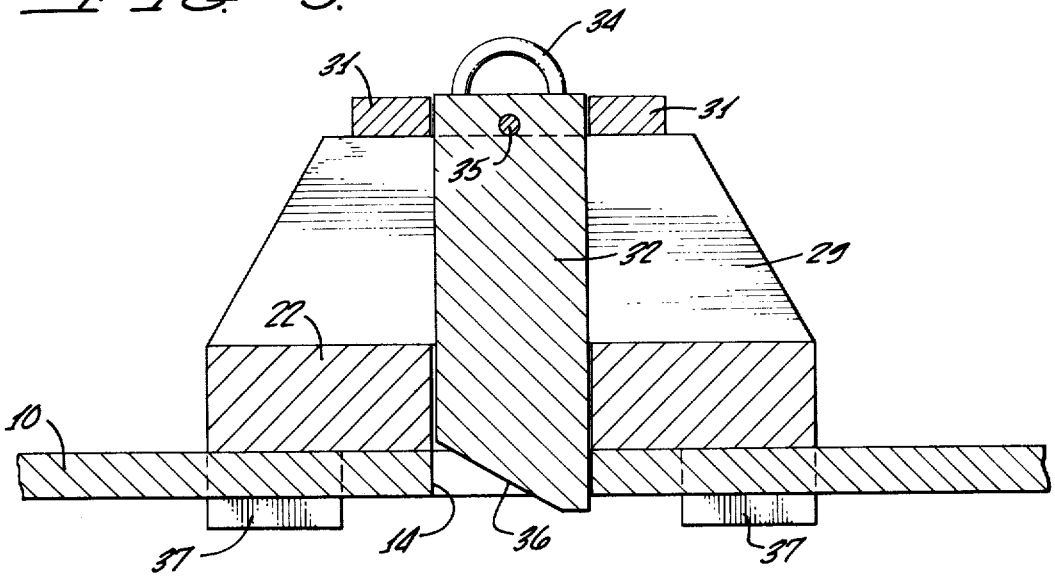
FIG. 5 shows a vertical section of the cross head of FIG. 4, taken along the line 5 — 5, particularly illustrating one of the latches.

As will be seen more clearly in FIGS. 4 and 5, cross heads 22 are provided with longitudinal plates 29 and 30 fixedly attached to cross bars 31 to form housings around corresponding apertures in cross heads 22 in which are placed so as to be slidable vertically, a pair of latches 32 each provided with top handle 34. Latches 32 are maintained vertically in position for ratcheting action, described hereinafter, and prevented from sliding out of the bottoms of their housings, by attached pegs 35 which rest on top surfaces of longitudinal plates 29 and 30. Latches 32 in each pair are spaced apart transversely the same distance as are slots 14 in rail 10, are slightly smaller in length and width than slots 14, and are characterized by longitudinally bevelled bottom surfaces as at 36 as seen in FIG. 5. When piston ends 27 are retracted into hydraulic cylinders 24 from their positions shown in FIG. 1, cross heads 22 are moved to the left (in the drawings) while the bevelled bottom edges of latches 32 ratchet over the edges of slots 14 and their intervening structure; sled 15 remains stationary. When piston rods 27 are again extended, the lower bottom ends of latches 32 will bear against the corresponding edges of slots 14 to hold cross heads 22 in place while sled 15 is moved incrementally to the left.

Means are provided for maintaining each pair of latches 32 in each cross head 22 in transverse alignment with the pairs of slots 14 in rail 10, which, in the embodiment illustrated, comprise turned-under brackets 37 attached to the undersides of cross heads 22 which capture the side edge portions of flange 12 of rail 10, and, preferably in addition, guides 38 also attached to the undersides of cross heads 22, which bear against the side edges of flange 12.

Figure 6:
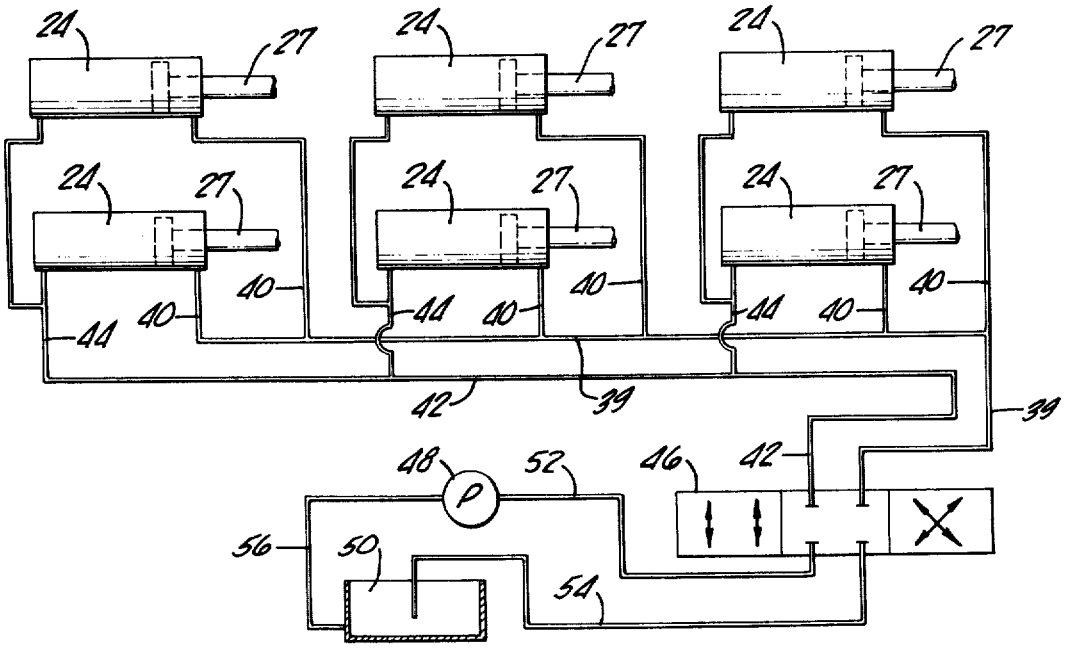
FIG. 6 shows a schematic and simplified illustration of the hydraulic connections for actuation of hydraulic cylinders in the jacking apparatus of FIG. 1.

Referring now to FIG. 6 a simplified schematic diagram shows the means for causing simultaneous, alternate retraction and extension of the piston rods of hydraulic cylinders 24, and which comprise a hydraulic circuit in which one fluid line 39 connects one end of each of double acting hydraulic cylinders 24 through branch lines 40, and another fluid line 42 connects the other ends of hydraulic cylinders 24 through branch lines 44. Fluid lines 39 and 42 are connected to one side of 3 position valve 46 as shown, while a high pressure pump 48 and a reservoir 50 are connected by fluid lines 52 and 54 to the other side of 3 position valve 46, and to each other by fluid line 56. Valve 46 is shown in its central or "Off" position. When actuated to place the right hand box (in the drawings) in operative connection, hydraulic fluid will be pumped simultaneously to the right hand ends of cylinders 24 through fluid lines 52, 39 and 40 and fluid is returned to reservoir 50 through fluid lines 44, 42, and 54. When valve 46 is actuated to place the left hand box (in the drawings) in operative connection then hydraulic fluid will be pumped simultaneously to the left hand ends of cylinders 24 through fluid lines 52, 42 and 44 and returned to reservoir 50 through fluid lines 40, 39 and 54.

Push bar 58 may be attached as by pins 60 passing through it and forks 62 attached to sled end cross member 18*a*, for convenient engagement with a load to be pushed.

In operation of the jacking apparatus of this invention it may first be placed on rail 10 with its push bar 58 abutting a load to be moved, for example a pipe section or jacket to be transferred on or off a barge, the load being also slidable on rail 10.

With push bar 58 up against the load and pump 48 operated to provide oil under pressure, valve 46 is moved to the left to connect pressurized oil through lines 52, 39 and 40 to the right hand ends of hydraulic cylinders 24 which will move their pistons and retract their piston rods 27 to move cross heads 22 to the left, (as shown in the drawings) while latches 32, set in the position shown in FIG. 5, ride up and out of slots 14 and over the intervening structure of rail 10. At the end of the left hand stroke of piston rods 27, valve 46 is actuated to reverse the pressurized oil flow, and cause it to flow into the left hand ends of hydraulic cylinders 24. This causes the lower end of latches 32 to engage the slots 14 in rail 10 and to hold cross heads 22 in fixed relation to rail 10. As pressurized oil is supplied to the left hand ends of hydraulic cylinders 24 and with the cross heads 22 fixed by latches 32, sled 15 is forced to the left and moves the load in this direction for the remainder of the piston stroke. At the end of this piston stroke the oil flow is again reversed to cause another recovery stroke with cross heads 22 moving to the left and ratcheting over the slots 14 in rail 10. The cycle is repeated to produce repetitive incremental push movements of the load in a left hand direction.

For movement of a load in the other direction, which would be a pulling effort with the sled oriented as shown, push bar 58 may be removed and the load attached to forks 62 as by pins 60. Latches 32 are now reversed longitudinally by lifting them by their handles 34 out of their housings, and reversing them end for end so that the slope of their bevelled bottoms 36 is also reversed. Repetitive reciprocal actuation of piston rods 27 of hydraulic cylinders 24 by operation of valve 46 will cause corresponding reciprocal motion of cross heads 22 but latches 32 will now hold in slots 14 on retraction of piston rods into hydraulic cylinders 24 to cause a pull and right hand travel of sled 15 and its attached load along rail 10. Latches 32 will ratchet over slots 14 and their intervening structure driving the right hand or recovery travel of cross heads 22 when piston rods 27 are extended for another cycle. The load attached to forks 62 on sled 15 is thereby pulled repetitively and incrementally along rail 10 in the right hand direction (in the drawings).

To move extremely heavy loads, several, for example two or more, units of the jacking apparatus, each comprising a sled assembly and slotted rail, may be arranged in side-by-side relationship to provide a multiple rail base, or ways, with correspondingly multiplied moving or jacking power. All units could be operated by synchronized hydraulic systems as described. working An important feature of the jacking apparatus of this invention is the flexible structure resulting from the pivotable attachment of sled cross members 18 to side members 16 and the pivotable attachment of hydraulic cylinders 24 to sled cross members 18, and their piston rods 27 to cross heads 22. As a result of this construction slots 14 in flange 12 of rail 10 do not need to be accurately machined and located. They may be very simply and economically flame cut in the flanges of rail 10. An appreciable amount of misalignment of the working edges of slots 14 can be tolerated since the flexibility of the cross head hydraulic cylinder and sled member pivotable attachments will permit the cross heads to assume sufficient angularity to ensure contact between the latches and the working edges of all the slots engaged by the latches. Since common ends of all the hydraulic cylinders 24 are connected in the same hydraulic circuit equal pressure and driving force will be applied to every one of the slots engaged. In large working jacking systems according to this invention, misalignment or length variation in the slot edges of as much as one quarter of an inch can be tolerated so that flame cutting of slots can produce quite acceptable slot dimension and location accuracy.

Another important feature of this invention is the longitudinal reversability of the latches 32 in their housings. Since the latches are freely slidable upward and can readily be lifted out by their handles 34, the direction of their bottom bevels at 36 can be reversed easily and quickly to provide jacking action in the reverse direction.

The arrangement of the plurality of hydraulic cylinders as described is advantageous because it makes possible employment of smaller individual hydraulic cylinders rather than a smaller number of much larger ones or even a single very large one. Yet with the novel design of cross heads, latches and sled according to this invention, the same force can be applied against each of a number of slots in a rail, even though these may be economically flame cut and not necessarily absolutely accurately located or dimensioned. I claim:

1. Jacking apparatus having a plurality of hydraulic cylinders arranged to move a load along a rail; in which the improvement comprises:

a. a rail having a plurality of pairs of vertical slots uniformly spaced along the length of said rail, said slots in each pair being transversely aligned;

b. a sled comprising a pair of spaced apart side members pivotably connected to a plurality of spaced apart cross members slidably mounted on said rail;

c. a plurality of cross heads slidably mounted on said rail, each of said cross heads being spaced apart from an adjacent sled cross member;

d. hydraulic cylinders pivotably attached between the outer ends of each of said cross heads and the said adjacent sled cross members;

e. a pair of transversely aligned latches having longitudinally bevelled bottom surfaces mounted in each of said cross heads so as to be vertically slidable and engageable with said slots in said rail;

f. means for maintaining said pair of latches in each of said cross heads in transverse alignment with said pairs of slots in said rail;

g. means for causing simultaneous alternate retraction and extension of the piston rods of said hydraulic cylinders, thereby to cause repetitive, incremental movement of said sled along said rail by engagement of said latches with said slots in said rail when said cross heads are moved by said hydraulic cylinders in one direction with respect to said sled, and sliding of the bevelled bottom edges of said latches over edges of said slots in said rail when said cross heads are moved by said hydraulic cylinders in the other direction with respect to said sled; and, h. means on an end of said sled for engaging a load to be moved along said rail.

2. Jacking apparatus according to claim 1 in which said slots are flame cut in said rail.

3. Jacking apparatus according to claim 1 in which said sled comprises a pair of side members having three spaced apart cross members slidably mounted on said rail.

4. Jacking apparatus according to claim 1 in which the said hydraulic cylinders each have their bases pivotably attached to said sled cross members, and their piston rods pivotably attached to said cross heads.

5. Jacking apparatus according to claim 1 in which the said latches are removable and longitudinally reversible in their housings in said cross head.

6. Jacking apparatus according to claim 1 in which a load push bar is releasably attached to an end of said sled.

7. Jacking apparatus according to claim 1 in which the means for maintaining said pair of latches in each of said cross heads in transverse alignment with said pairs of slots in said rail comprise turned-under brackets attached to said cross heads to slidably capture the side edges portions of said rail, and guides attached to said cross heads to bear against side edges of said rail.

* * * * *